US006863055B2

(12) United States Patent
Rueger

(10) Patent No.: US 6,863,055 B2
(45) Date of Patent: Mar. 8, 2005

(54) METHOD AND DEVICE FOR CONTROLLING A PIEZO-ACTUATOR

(75) Inventor: Johannes-Joerg Rueger, Vienna (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,348

(22) PCT Filed: Feb. 26, 2002

(86) PCT No.: PCT/DE02/00698

§ 371 (c)(1),
(2), (4) Date: Apr. 16, 2003

(87) PCT Pub. No.: WO02/077432

PCT Pub. Date: Oct. 3, 2002

(65) Prior Publication Data

US 2003/0150429 A1 Aug. 14, 2003

(51) Int. Cl.[7] ..... F02D 41/20
(52) U.S. Cl. ..... 123/478
(58) Field of Search ..... 123/478, 480, 123/490, 498; 310/316.03

(56) References Cited

U.S. PATENT DOCUMENTS 4,728,074 A * 3/1988 Igashira et al. ..... 251/57
6,146,102 A * 11/2000 Otome et al. ..... 123/498
6,147,433 A 11/2000 Reineke et al. ..... 310/316.03
6,157,174 A 12/2000 Hoffmann et al. ..... 320/166

FOREIGN PATENT DOCUMENTS

| | | |
|---|---|---|
| DE | 197 32 802 | 2/1999 |
| DE | 199 21 456 | 11/2000 |
| DE | 199 31 235 | 1/2001 |

* cited by examiner

*Primary Examiner*—Andrew M. Dolinar
(74) *Attorney, Agent, or Firm*—Kenyon & Kenyon

(57) ABSTRACT

A method of triggering a piezoelectric actuator which controls the injection of fuel into the combustion chamber of an internal combustion engine via a valve is described in which the operating situation of the engine is determined and the derivative with respect to time of the voltage, which can be picked off at the piezoelectric actuator, is selected as a function of the operating situation. Furthermore, a control unit for controlling a fuel injection system is described, in which a piezoelectric element is triggered so that the derivative with respect to time of the voltage, which can be picked off at the piezoelectric actuator, is adjusted to the operating situation of the engine. Additionally described is a fuel injection system, having at least one piezoelectric actuator which is triggered accordingly.

13 Claims, 4 Drawing Sheets

METHOD AND DEVICE FOR CONTROLLING A PIEZO-ACTUATOR

FIELD OF THE INVENTION

The present invention relates to a method, a control unit, and a fuel injection system, respectively, where a piezoelectric actuator is electrically recharged by the application of an electric current in order to change its length.

BACKGROUND INFORMATION

Such a method, in which the derivative with respect to time of the voltage applied to the piezoelectric actuator is changed within a charging or discharging operation, is discussed in German Published Patent Application No. 199 21 456.

SUMMARY OF THE INVENTION

The exemplary method and the exemplary devices according to the present invention may lower the noise emissions of the injection system in those operating situations where they are significantly influenced by the triggering of the piezoelectric actuators utilized. In addition, in common rail injection systems in particular, the system behavior, i.e., the accuracy of triggering, as well as the metering of the injected quantities may remain unaffected, such as, for exampe, at high rail pressures, i.e., that even at high rotational speeds or high loads on the internal combustion engine the required timing tolerances with respect to triggering, as well as the accuracy of the metered quantity, may be complied with.

DETAILED DESCRIPTION

Figure 1A:
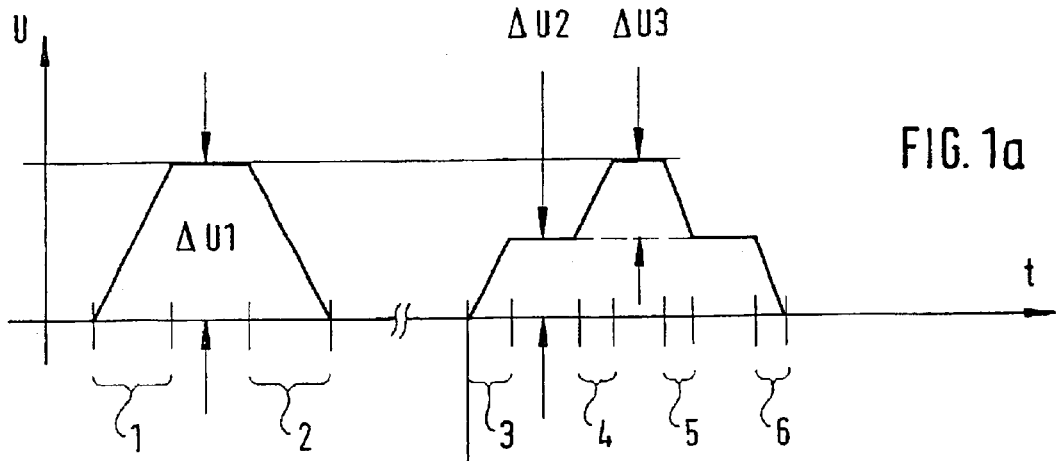
FIG. 1 shows two voltage-time diagrams.
Figure 1B:
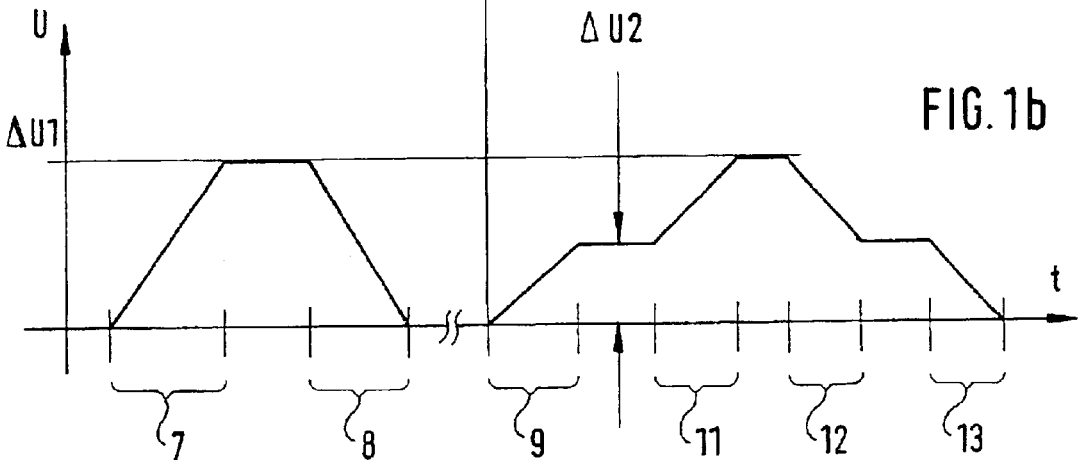

FIG. 1*a* shows a voltage-time diagram. It shows the variation of voltage over time across a piezoelectric actuator which controls the injection of fuel into the combustion chamber of an internal combustion engine via a valve. Two standard triggering characteristics are illustrated. In the first triggering, voltage U is linearly increased within charging time 1 from zero to a value ΔU1 which is maintained for a certain time (e.g., ΔU1=200 V). During subsequent discharging time 2, the voltage applied to the piezoelectric actuator is again linearly reduced to zero. The second triggering has an intermediate level ΔU2 (e.g., ΔU2=100 V), to which the voltage is initially increased within charging time 3. After reaching this voltage level, the voltage is increased by the difference value ΔU3 (e.g., ΔU3=100 V) within additional charging time 4, to be only subsequently reduced in two steps to the value zero within discharging times 5 and 6. FIG. 1*b* shows similar voltage characteristics having identical voltage levels ΔU1 and ΔU2, respectively. However, the charging times and discharging times 7, 8, 9, 11, 12, and 13 are longer than the charging times and discharging times 1 through 6 in FIG. 1*a*. The absolute value of the derivatives with respect to time of the voltage characteristics in the charging times and discharging times is therefore less than in FIG. 1*a*. Any triggering characteristics that may be represented by broken lines may be supported and the above description is appropriately applicable.

In injection systems having piezoelectric actuators, a control valve which controls the movement of the nozzle needle may not be triggered directly, but via a hydraulic coupler, as discussed in German Published Patent Application No. 197 32 802, for example. This coupler has essentially two functions: First, it reinforces the lift of the piezoelectric actuator and second, it decouples the control valve from the static thermal expansion of the actuator. The triggering voltage required for accurate positioning of the control valve and thus for implementing a desired injection may be heavily dependent on the fuel pressure and, in a common rail system, on the rail pressure of the fuel. This may be explained by the feature that the control valve works against or with the rail pressure, depending on the switching direction of the valve. The derivative with respect to time of the triggering voltage may be selected so that the charging time and discharging time correspond exactly to the time constant of the mechanical system. The vibration induced in the system may be minimized in this case. For different reasons, it may be desirable to keep the charging time and discharging time as short as possible, in particular to implement triggering periods as short as possible, in order to supply the smallest injected quantities, which may be important at high rail pressures.

On the other hand, the noise emission may increase notably with the gradient, i.e., the derivative with respect to time of the voltage since, due to the high speed of the actuator movement, the control valve is also moved with similar speed. This effect may be interfering in certain operating situations of the engine. In this connection, the expression "operating situation" is not to be understood as a certain period of time within a triggering of the piezoelectric actuator, but rather as the operating condition, generally present through several injection cycles, such as idling, for example, which may be characterized by small load and low rotational speed. Triggering according to FIG. 1*a* may be used in normal driving operation under load, while in the operating situation "idling", a triggering according to FIG. 1*b* having a flatter triggering gradient may achieve a reduction in noise emission, particularly here where the noise caused by triggering of the injection system is noticeable compared to other vehicle noises.

Figure 2:
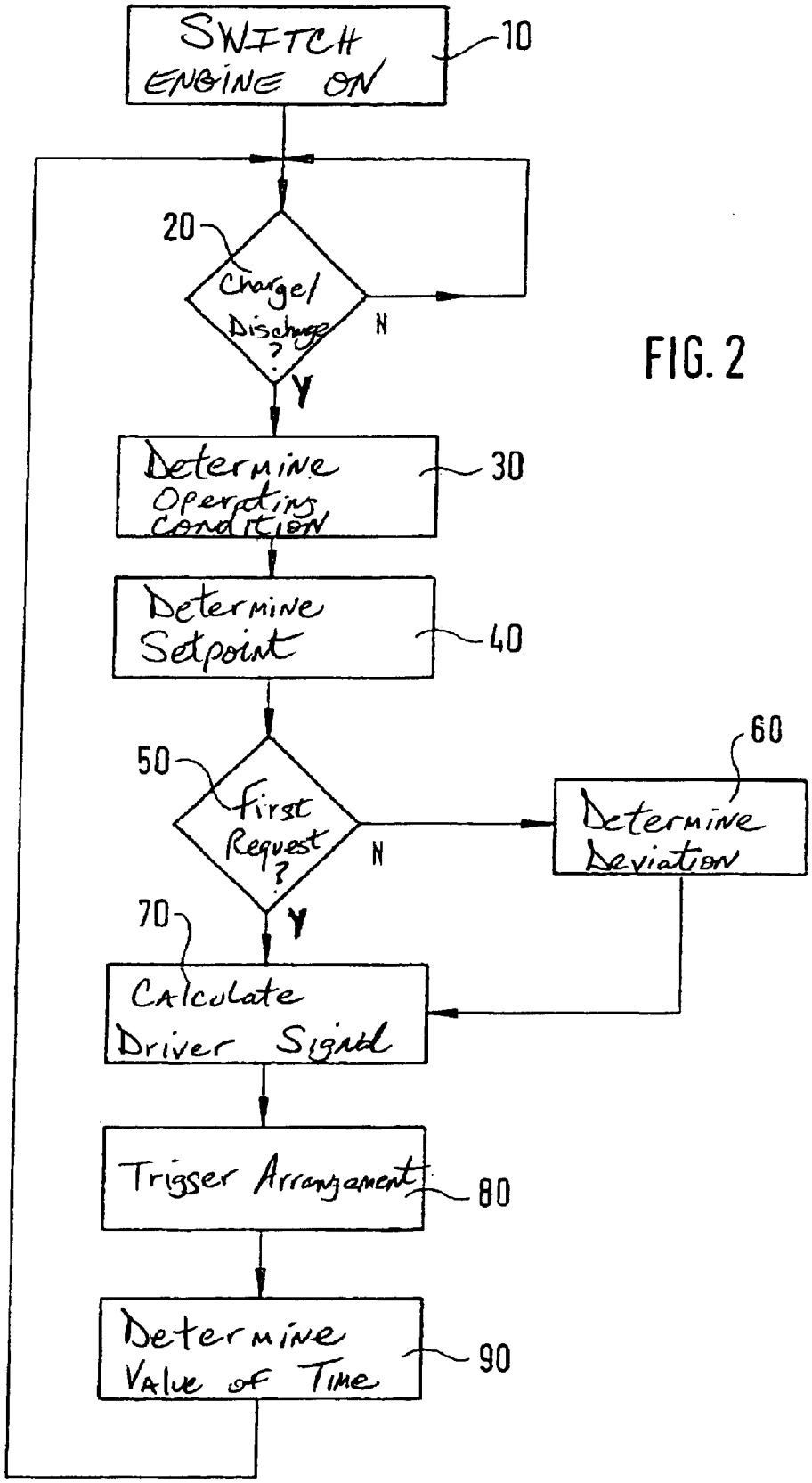
FIG. 2 shows a flow diagram.

FIG. 2 illustrates the procedure of triggering of a piezoelectric actuator which, in a common rail injector for example, may control the injection of diesel fuel into the combustion chamber of the diesel engine. After switching on 10 of the engine, i.e., the injection system, it is first verified in query 20 whether a charging/discharging operation is requested. If this is the case, the operating condition of the engine is determined (process step 30). The operating condition of the engine may be characterized by the rotational speed and/or the load on the engine and/or by the fuel pressure in the injection system. Further characterizing variables may be the temperature of the piezoelectric actuator, the temperature of the fuel, or other characteristic data. In subsequent process step 40, the setpoint of the derivative with respect to time of the voltage which is to be applied to the piezoelectric actuator is determined as a function of the operating condition of the engine. The gradient setpoint is set here so that the noise development due to the movement of mechanical components may be minimized while the functionality of the injection system is preserved. When certain threshold values of the rotational speed, the load torque, and/or the rail pressure are reached here (e.g., rotational speed<2000 rpm, the load is less than 10% of the maximum load and the rail pressure is below 500 bar), then a smooth transition of the gradient setpoint, in comparison to "normal operation," is implemented, so that below the threshold values mentioned, the derivative with respect to time of the voltage to be applied changes over continuously to smaller values. The charging time or the discharging time varies typically (e.g., at 50% of the maximum load) between 80 $\mu$s and 100 $\mu$s, while it assumes values between 100 $\mu$s and 150 $\mu$s below the threshold values.

In subsequent query 50, it is checked whether it is the first request of the injection system after switching on. If yes, a driver signal is calculated for a driver which triggers a charging/discharging arrangement to be applied to the piezoelectric actuator. The driver signal is calculated here so that a sufficient electric current is fed to the piezoelectric actuator in order to achieve the determined setpoint of the derivative with respect to time or the charging/discharging time of the voltage to be applied. In additional step 80, the driver that triggers the charging/discharging arrangement is triggered until the final value of the electric voltage across the piezoelectric actuator is reached. In an additional step 90, the actual value of time is determined, which was required to charge or discharge the piezoelectric actuator to the voltage to be achieved. The program subsequently returns to query 20.

If in query 50 the result is "No," then the system deviation, i.e., the deviation of the last actual value of the time needed for the recharging, from the calculated setpoint, is determined and is taken into account in subsequent process step 70 for calculating the driver signal for the next recharging of the piezoelectric actuator.

The change in triggering only in certain operating points, such as idling (characterized above by the threshold values mentioned), may be entirely sufficient, since, due to triggering, only in these points may the noise, imitated by the injector, significantly influence the overall noise of the drive unit. In partial load or full load operation, however, the overall noise may be far dominated by the combustion noise. The present invention is based on the idea that in order to implement a more constant charging/discharging time in the range of the system time, the triggering gradients, i.e., the charging/discharging times are not changed, as previously, as a function of the voltage, but are switched over to a flatter gradient in certain operating situations, in particular during idling. In doing so, the noise emission may be significantly reduced. The rail pressure may also be relatively low during idling, so that even during longer charging/discharging times, the smallest injected quantities may be implemented and the narrow tolerances to be adhered to with regard to the injected quantities may be ensured.

Alternatively to a smooth transition of the gradient or she time setpoint between normal operation and idling, a hard switch-over to smaller gradients may also be provided when one or several of the threshold values fall below a certain value.

Figure 3:
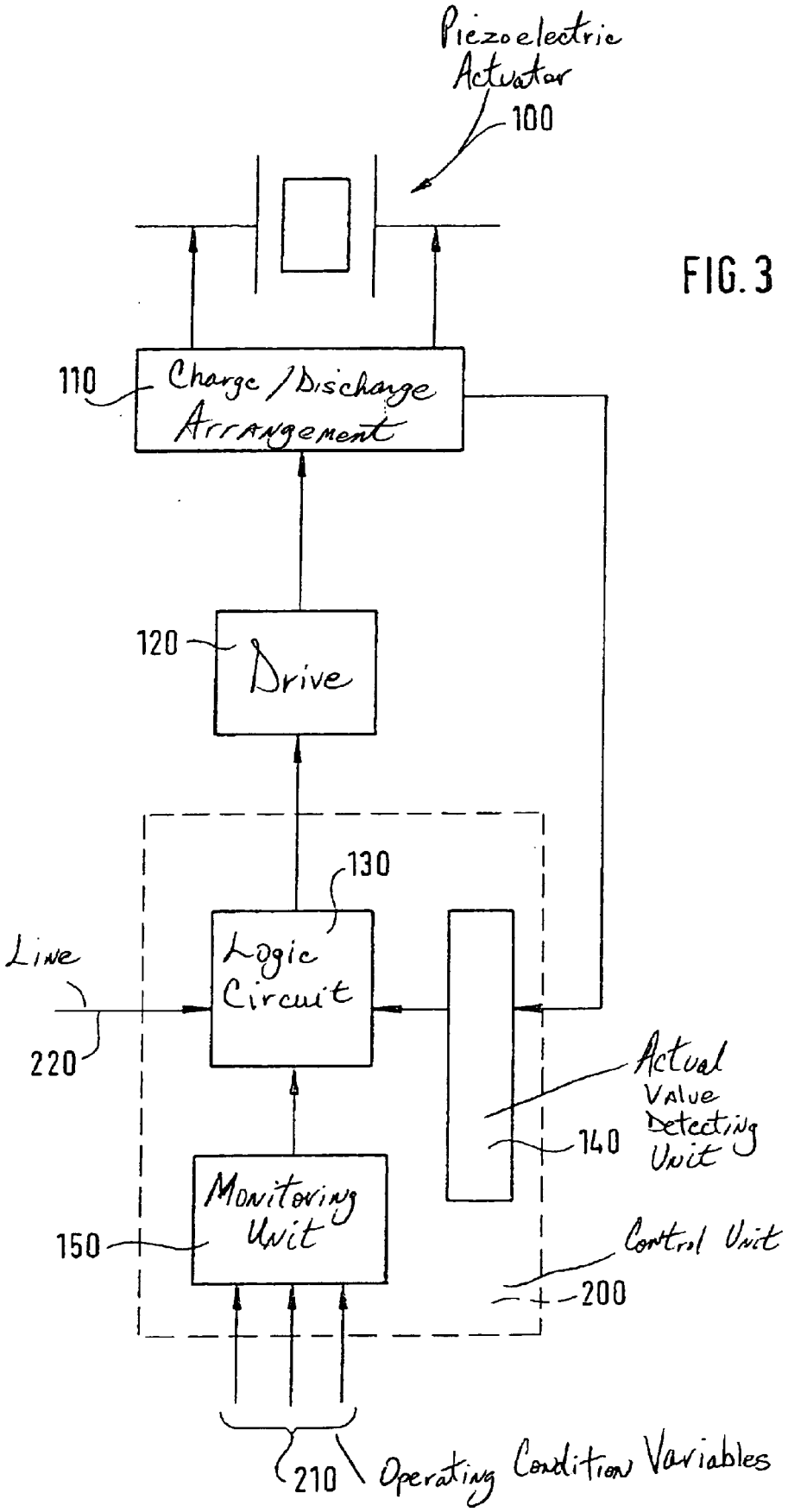
FIG. 3 shows a block diagram.

FIG. 3 shows a control unit 200 which is connected to a driver 120 and charging/discharging arrangement 110. The control unit has a monitoring unit 150 which is supplied with operating condition variables 210. These operating condition variables are the rotational speed, the load torque, the rail pressure, and/or the temperature of the piezoelectric actuator, and/or the fuel temperature, and/or other parameters. Monitoring unit 150 determines the setpoints for the charging/discharging times and the charging/discharging gradients and transmits these to logic circuit 130. Logic circuit 130 is connected to an actual value detecting unit 140, which, as illustrated in FIG. 3, may be integrated into the control unit, but may also be arranged separately in the immediate proximity of charging/discharging arrangement 110. Actual value detecting unit 140 is connected to charging/discharging arrangement 110. Logic circuit 130 may receive a request signal from higher-level engine control units (not shown) via line 220. Logic circuit 130 is connected to a driver 120 which, in turn, is interconnected with charging/discharging arrangement 110 which applies a voltage to piezoelectric actuator 100 as a function of time.

The setpoint for the charging/discharging time is determined in monitoring unit 150, taking into consideration the variables rotational speed, load, and rail pressure, and the monitoring unit transmits the determined value to logic circuit 130. Upon request, logic circuit 130 calculates a driver signal via signal line 220 taking into consideration the actual value of the charging/discharging time or the charging/discharging gradient measured by actual value detection unit 140. Logic circuit 130 conveys the driver signal to driver 120 which then triggers charging/discharging means 110 in order to implement the voltage gradients to be achieved across piezoelectric actuator 100.

To regulate the control gradients during the recharging phases, variables other than rotational speed load and/or rail pressure may be alternatively used for determining the operating condition of the engine and/or the injection system.

Figure 4:
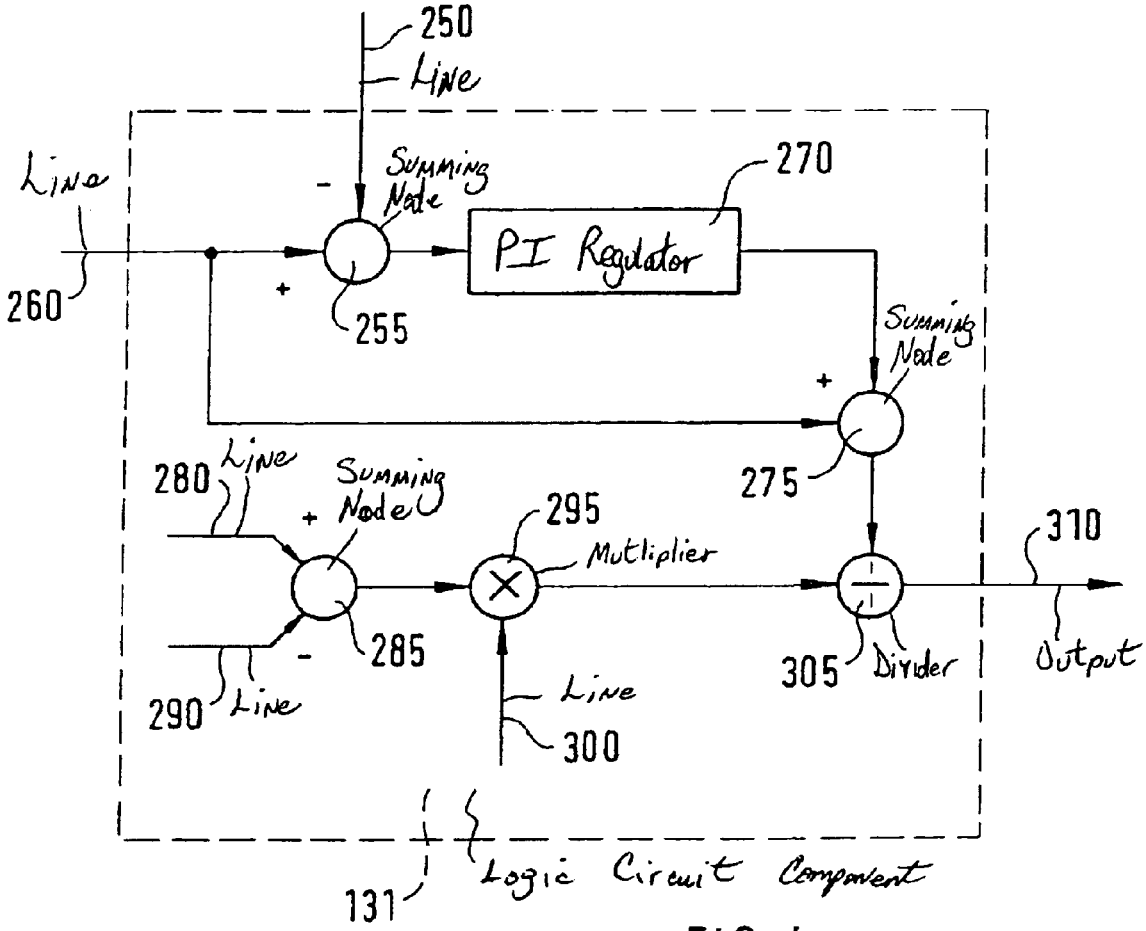
FIG. 4 shows an additional block diagram.

FIG. 4 shows a component 131 of logic circuit 130 in the form of a block diagram. The actual value detected by actual value detection unit 140 and the setpoint calculated by monitoring unit 150 are fed to a summing node 255 via lines 250 and 260, respectively. The summing node calculates the system deviation, i.e., the difference between the setpoint and the actual value and feeds this difference to PI regulator 270, i.e., a proportional amplifier, which is connected in parallel to an integrator. The output of PI regulator 270 is connected to a second summing node 275 which adds the output value of the PI regulator to the setpoint from monitoring unit 150. Prior to or following the recharging procedure to be calculated, the voltage levels are fed via lines 280 or 290 to a third summing node 285 which calculates their difference and feeds it to multiplier 295 which, in turn, calculates the charge required for the recharging procedure from the difference and the value of the capacitance of the piezoelectric actuator fed via line 300. Divider 305 divides the value of the electric charge, obtained from multiplier 295, by the value of the charging/discharging time obtained from summing node 275, so that the information about the current value required for the recharging procedure at the piezoelectric actuator may be picked off at output 310 of divider 305. Output 310 of divider 305 is connected to driver 120 and is available to it for triggering charging/discharging means 110 (see FIG. 3). Lines 280, 290, and 300 are connected either to storage elements in which the voltage and capacitance values to be retrieved are stored, or they are connected to separate circuit elements (not shown) which recalculate or define the voltage and capacitance values, as a function of the triggering demand and switching condition.

Component 131 implements the process steps illustrated in FIG. 2. The charging and discharging time are regulated by a PI regulator, the difference between the voltage levels to be bridged, and the actuator capacitance of the associated charging and discharging current being determined.

What is claimed is:

1. A method of triggering a piezoelectric actuator which controls an injection of fuel into a combustion chamber of an internal combustion engine via a valve, the method comprising:

applying an electric current to one of at least partially charge and discharge the piezoelectric actuator and to change a length of the piezoelectric actuator;

determining an operating situation of the internal combustion engine; and selecting, as a function of the operating situation, a derivative with respect to time of a voltage across the piezoelectric actuator during a charging/discharging time;

wherein the operating situation is defined by at least one of a rotational speed and a fuel pressure in an injection system of the internal combustion engine.

2. The method of claim 1, wherein the injection system is a common rail system, and the fuel pressure is a pressure of the fuel in a rail of the common rail system.

3. The method of claim 1, further comprising:

reducing, if the operational situation is a low fuel pressure, the derivative with respect to time compared to the operating situation of at least one of a higher rotational speed and a higher fuel pressure.

4. The method of claim 3, wherein the derivative with respect to time is reduced during an idling of the internal combustion engine.

5. The method of claim 1, further comprising:

adjusting an absolute value of the electric current applied to the piezoelectric actuator during charging and discharging, depending on the derivative with respect to time to be achieved.

6. The method of claim 1, wherein the internal combustion engine is a diesel engine.

7. A control unit for controlling a motor vehicle injection system, comprising:

at least one piezoelectric actuator to inject fuel into a combustion chamber of an internal combustion engine via a valve;

an electric current applied to the at least one piezoelectric actuator to one of at least partially charge and discharge the at least one piezoelectric actuator and to change a length of the at least one piezoelectric actuator; and a monitoring unit to determine an operating situation of the internal combustion engine so that a derivative with respect to time of a voltage across the at least one piezoelectric actuator during a charging/discharging time is selectable as a function of the operating situation;

wherein the operating situation is defined by at least one of a rotational speed and a fuel pressure in an injection system of the internal combustion engine.

8. The control unit of claim 7, wherein the fuel pressure is given by a pressure of the fuel in a rail of a common rail system of the internal combustion engine.

9. The control unit of claim 7, wherein, upon at least one of a low rotational speed and a low fuel pressure, the monitoring unit is configured to reduce the derivative with respect to time as compared to operating situations of at least one of a higher rotational speed and a higher fuel pressure.

10. The control unit of claim 9, wherein the derivative with respect to time is reduced during an idling of the internal combustion engine.

11. The control unit of claim 7, wherein an absolute value of the electric current applied to the piezoelectric actuator during charging and discharging, respectively, is adjusted as a function of the derivative with respect to time to be achieved.

12. The control unit of claim 7, wherein the internal combustion engine is a diesel engine.

13. A fuel injection system comprising:

at least one piezoelectric actuator for injecting fuel into a combustion chamber of an internal combustion engine via a valve;

an electric current applied to the piezoelectric actuator to at least one of at least partially charging and discharging the at least one piezoelectric actuator and to change a length of the at least one piezoelectric actuator; and a control unit to determine an operating situation so that a derivative with respect to time of a voltage across the at least one piezoelectric actuator during a charging/discharging time is selectable as a function of the operating situation;

wherein the operating situation is defined by at least one of a rotational speed and a fuel pressure in an injection system of the internal combustion engine.

* * * * *